United States Patent [19]

Suzuki et al.

[11] 4,197,115

[45] Apr. 8, 1980

[54] METHOD FOR MANUFACTURING PELLETS

[75] Inventors: Satoru Suzuki, Kitakyusyushi; Katsuhiko Sato, Munakatamachi; Takeo Furui, Tokyo, all of Japan

[73] Assignee: Nippon Steel Corporation, Tokyo, Japan

[21] Appl. No.: 897,162

[22] Filed: Apr. 17, 1978

[30] Foreign Application Priority Data

Apr. 18, 1977 [JP] Japan ..... 52/043480

[51] Int. Cl.[2] ..... C22B 1/243; C22B 1/244

[52] U.S. Cl. ..... 75/3; 264/6; 264/117

[58] Field of Search ..... 75/3, 4, 5; 264/117, 264/6; 23/313 R, 313 P; 241/15, 14; 44/10 F

[56] References Cited

U.S. PATENT DOCUMENTS 2,771,355 10/1958 Cohen ..... 75/3

3,969,103 7/1976 Copes et al. ..... 75/3

4,001,007 1/1977 Sasakiet al. ..... 75/5

FOREIGN PATENT DOCUMENTS 41-8041 4/1966 Japan ..... 75/5

OTHER PUBLICATIONS

Knepper, W., ed; *Agglomeration*, Interscience Publishers, New York, NY, pp. 965–975.

*Primary Examiner*—L. Dewayne Rutledge

*Assistant Examiner*—Michael L. Lewis

*Attorney, Agent, or Firm*—Wenderoth, Lind & Ponack

[57] ABSTRACT

A method for economically manufacturing high-grade pellets for metallurgical use in a blast furnace from several grades of iron ores, which method can produce high-strength green pellets and save grinding cost by preferentially grinding only ores having a W.I. value not higher than 20 KWH/T, thus relatively easy to grind ores, and mixing the thus ground ores with ores which are hard to grind, in an agglomerating (lump-making) step, such as a pelletizing step.

7 Claims, 7 Drawing Figures

METHOD FOR MANUFACTURING PELLETS

BACKGROUND OF THE INVENTION

Field of the Invention

The present invention relates to a method for economically manufacturing high-grade pellets for metallurgical use in a blast furnace from several grades of iron ores. The present method can produce high-strength green pellets and save grinding cost by preferentially grinding only ores having a W.I. value not higher than 20 KWH/T, which are relatively easy to grind, and mixing the thus ground ores with ores which are hard to grind in an agglomerating (lump-making) step, such as a pelletizing step. The green pellets manufactured by the present method are free from powderization or deformation which causes difficulties in the pellet manufacturing process.

In a process of manufacturing pellets, the strength of the green pellets is one of the most important factors which control the product grade and the productivity. For example, in the manufacturing of fired pellets by the grate-kiln process, when the strength of the green pellets is not enough, the green pellets are powderized before they are transferred and charged in a firing oven, thus hindering gas flow in a drying step or in a preheating step, thereby causing lowered productivity. Further, the powders brought into the firing step stick on the inside wall of the kiln to form a so-called ring thereon, which prevents the travelling of the materials through the kiln, thus causing failure in the kiln operation.

Also in the non-fired pellet manufacturing process, which has been looked upon with great interest as an effective non-pollution means, when the strength of the green pellets is not enough, they are powderized or deformed before they are transferred and charged in a curing means, thus lowering their rate of production. Further, the powderized pellets cause a strong adhesion among the pellets during the curing step, so that in the case where a curing vessel of a hopper type is used, it is impossible to discharge the pellets therefrom and in the case where a curing equipment of a yard type is used, it is difficult to discharge and crush the giant blocks of the pellets.

As the factors which have influence on the strength of green pellets, there are raw material factors, such as the particle size and form of the raw materials, and equipment or operation factors, such as types and amounts of binders used, the water content, types of mixing machines, as well as mixing conditions, types of pelletizing machines as well as pelletizing conditions. However, so far as the equipment or operation factors are constant, the raw material factors basically have a greater influence on the strength of green pellets.

DETAILED DESCRIPTION OF THE INVENTION

The present invention will be described by referring to the attached drawings.

Figure 1:
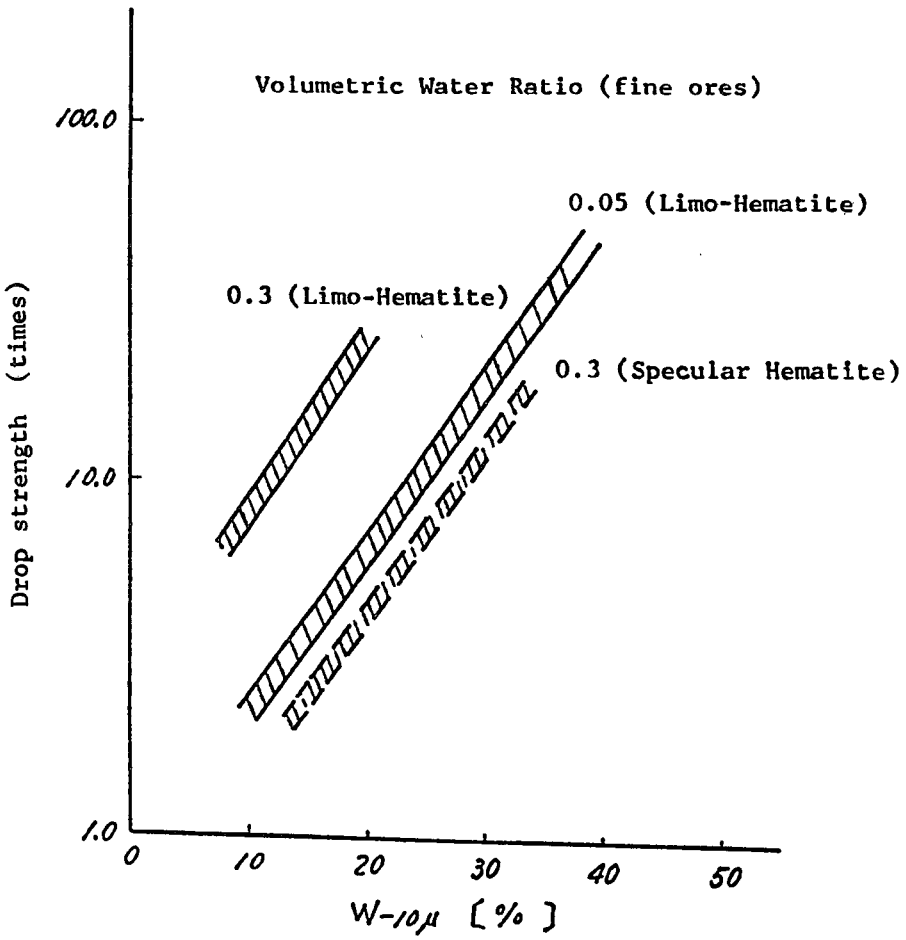
FIG. 1 shows the relation between the amount ($W-10\mu$) of fine particles not larger than 10 $\mu$m in the raw material and the drop strength of the resultant pellets.

Meanwhile, the present inventors used the distribution ratio of particles not larger than 10 $\mu$m in diameter (hereinafter expressed as $W-10\mu$), as an index representing the material factors and used the drop strength as a typical physical property representing the green pellet strength, and the present inventors have found there is a correlation between them as shown in FIG. 1. The index $W-10\mu$ is obtained by measuring the particle size distribution by a settling method in isopropylalcohol, while the drop strength is the number of dropping of the green pellet onto a steel plate from a height of 50 cm until the pellet is cracked or broken.

The term "volumetric water ratio" hereinafter used represents the ratio of the volume of water to the volume of the particles of the raw material to be charged in a pelletizer. When the volumetric water ratio exceeds 0.31, the pelletizing is impossible. It is clearly understood that good green pellets having a higher drop strength can be obtained when the particle size constitution of the raw material lie on the finer particle size range and where the $W-10\mu$ is larger.

As described above, the particle size constitution of the raw material is an important factor in the pellet manufacturing process, and as well known, in many pellet manufacturing plants and shops, a grinding machine, such as a ball-mill is provided so as to adjust the particle sizes of the raw materials, and it is also well known that the grinding cost occupies a large part of the pellet manufacturing cost. However, as the required drop strength of the green pellet is determined by the total drop-down distance to the curing equipment, it may vary depending on the scale and lay-out of the plant. If, however, the required drop strength is supposed to be 10 times, it is understood from FIG. 1 that if the volumetric water ratio is about 0.3, the $W-10\mu$ is required to be present 12% or more. Therefore, it is desirable to maintain a required amount of the $W-10\mu$ particles rather than to grind the raw material into about 44 $\mu$m as is conventionally done.

Further, there is a large difference in the strength between green pellets of limo-hematite and those of specular hematitle.

In FIG. 1, the volumetric water ratio of the specular hematite is controlled to 0.3 similarly as that of limo-hematite-specular hematite, and in the case of the specular hematite, a similar strength as that of limo-hematite-specular hematite can not be obtained unless the $W-10\mu$ is larger.

The above difference is considered to be caused by the fact that the liquid does not form a satisfactory liquid film around the particle surface of the specular hematite during the mixing step and that voids remain within the pellets during the pelletizing step so that the inside of the pellet is not filled with the liquid. Therefore, it is hardly expected that the specular hematite as very fine particles plays an important role in the pelletizing operation. As understood from the above illustration, the effect of the index W−10μ varies depending on the types of ores.

It is also understood from the foregoing illustration, that it is not always advantageous to grind all of the ores used for the preparation of the materials for pellets; rather it is more appropriate to grind certain types of ores, such as limohematite, which works effectively as fine particles and to use certain types of ores, such as specular hematite, which are not suitable as fine particles, in the form of coarse particles not larger than 0.5 mm, and it is also desirable that the easy-to-grind ores are finely divided to maintain them as W−10μ particles, if the same effect as the fine particles is obtained.

However, iron ore beds which have been underdevelopment in recent years contain an increasing proportion of specular hematite iron ores. The specular hematite is a kind of hematite in fish-scale form, which has a detrimental nature to the manufacturing of pellets in that it is more difficult to finely grind this material as compared with ordinary hematite or limonite.

The present invention makes it possible to admix a greater amount of specular hematite in the raw material for pellets by utilizing the characteristics of each type of iron ore, and which greatly contributes to the consistency of the pellet quality as well as to the lowering of the pellet manufacturing cost.

As a result of measurements of the W.I. (grinding work index) value of various types and grades of ores for the purpose of determining their grindability, the present inventors have found that iron ores can be largely classified into three groups as illustrated in Table 1.

The W.I. value as specified and defined by JIS M4002 is a measurement of the amount of grinding work required to grind the ore of ∞ diameter into particles of 100 μm in diameter (80%).

Table 1

| W.I. [KWH/T] | Types of Ores |
|---|---|
| <10 | limo-hematite A, limo-hematite B, limo-hematite C, limonite A |
| 10–20 | lime stone, magnetite A, magnetite B, hematite A, limonite B, hematite B |
| >20 | specular hematite A, specular hematite B, specular hematite C |

Thus, the group of W.I. <10 KWH/T includes the limonite and the limo-hematite, the group of W.I. 10–20 includes the limonite, the hematite and the magnetite, and the group of W.I. >20 includes the specular hematite.

FIG. 1 shows the results of pelletizing tests of the fine particles of −10 μm of ores having a W.I. value less than 10 and the fine particles of −10 μm of the ores having a W.I. larger than 20. Also, applicants have discovered that in the pelletizing tests of the magnetite, the hematite and the limonite, which are all in the W.I. 10–20 group, maintained in the form of fine particles of −10 μm results similar to those obtained with the ores of the W.I. <10 group can be obtained.

It is understood from the above results that it is desirable to use the ores of the W.I. >20 group without grinding or in the form of roughly divided particles, and to use the ores of the W.I. <20 group in the form of finely divided particles so as to maintain fine particles of −10 μm. It is more desirable to grind the limo-hematite which is an easy-to-grind ore so as to maintain the ore in the form of −10 μm particles and to use specular hematite in the form of roughly divided particles of not larger than 0.5 mm. As the means for crushing the iron ores into the particle size suitable for pelletizing, a closed circuit system is generally used, in which system the ores to be crushed are supplied to a classifier where fine particles of the ores smaller than the classifying point are separated and taken away out of the system, while the coarse particles larger than the classifying point are supplied to a crusher and, after being crushed, introduced to the above classifier where they are classified together with the starting ores to be crushed. In this way, the crushed ores finer than the classifying point are taken out of the system and used as direct materials for pelletization.

Figure 2:
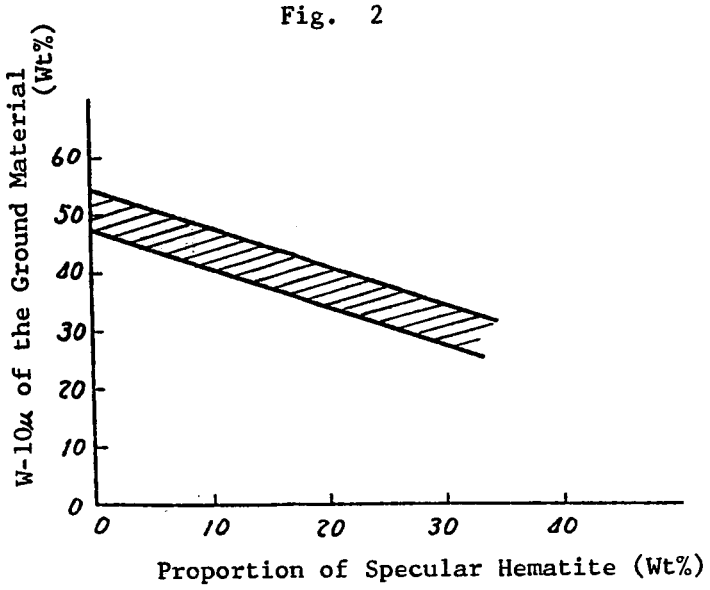
FIG. 2 shows the relation between the proportion of specular hematite and the $W-10\mu$ of the ground material.

The present inventors have clarified the relation between the mixing proportion of the specular hematite in the raw material mixture to be crushed for pellets and the W−10μ of the crushed ores by using such a closed circuit type crushing system, and the results as shown in FIG. 2 have been obtained.

As the proportion of the specular hematite increases, the W−10μ value of the crushed ores lowers to a coarse particle size, and the tendency is accompanied by a remarkable lowering of the strength of the green pellets as shown in Table 2.

Table 2

| Mixing Proportion of Specular Hematite (wt %) | Drop Strength (times) | Crushing Strength (kg/p) |
|---|---|---|
| 0 | 20 | 3.5 |
| 15 | 12 | 4.2 |
| 30 | 8 | 4.8 |
| 45 | 4 | 4.7 |

Therefore, about 30% is an upper limit of mixing the specular hematite for most of ordinary pellet plants, and mixing proportion beyond this limit will be confronted with considerable difficulties.

Now, the crushing degree of the specular hematite may be estimated from FIG. 2 as below.

The W−10μ value in the case where no specular hematite is admixed is 50% while the W−10μ value of the specular hematite prior to the crushing is almost zero. Supposing the specular hematite in the mixture is not crushed at all, the W−10μ of the mixture when 30% of specular hematite is mixed is calculated as $50\times0.7=3.5\%$, while the W−10μ in the same case can be read as 30 to 35% in FIG. 2. Therefore, when the ore mixture is crushed in the closed circuit system, it is understood from FIG. 1 and Table 2 that crushing of the easy-to-grind ores is hindered, although the specular hematite may be crushed to some degree, and thus the drop strength of the pellets is lowered.

As clearly understood from the above, it is necessary to strongly crush the specular hematite, if it is to be used as a raw material for pellets. For this purpose, it may be considered either to lower the classifying point or to crush the specular hematite alone separately. However, the lowering of the classifying point will naturally lower the capacity of the equipment and increase the unit power consumption, while the separate crushing of the specular hematite alone will require additional complicated steps and additional capital cost, thus disadvantages from the capital and economical aspect.

Therefore, one of the objects of the present invention is to overcome the above disadvantages.

Figure 3:
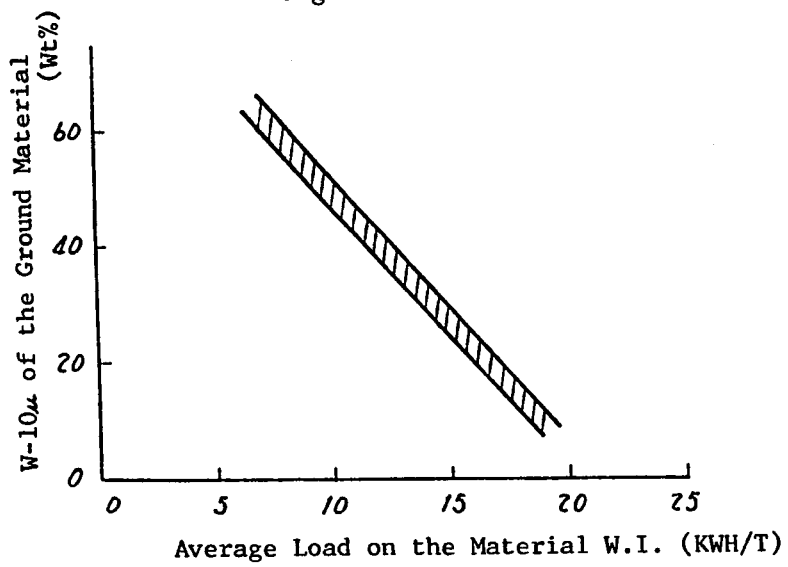
FIG. 3 shows the relation between the average load (W.I.) of the raw material and the $W-10\mu$ of the ground material.

The present inventors have conducted extensive experiments and studies on the relation between the W.I. index of various types of ores and the W−10μ values of the crushed ores, and have discovered the relation, as shown in FIG. 3, between the average load (W.I.) obtained when the types of ores shown in Table 1 are mixed and the W−10μ index of the crushed product obtained by actually grinding the mixture in a closed circuit type crushing system. As clearly understood from the relation, there is a very close correlation between the average load W.I. and the W−10μ index, and it is also understood that in the case of ores with the W.I. not larger than 10, the W−10μ becomes 60 or larger while in the case of ores having a W.I. value not less than 20, the W−10μ is only 10 or less.

Figure 4:
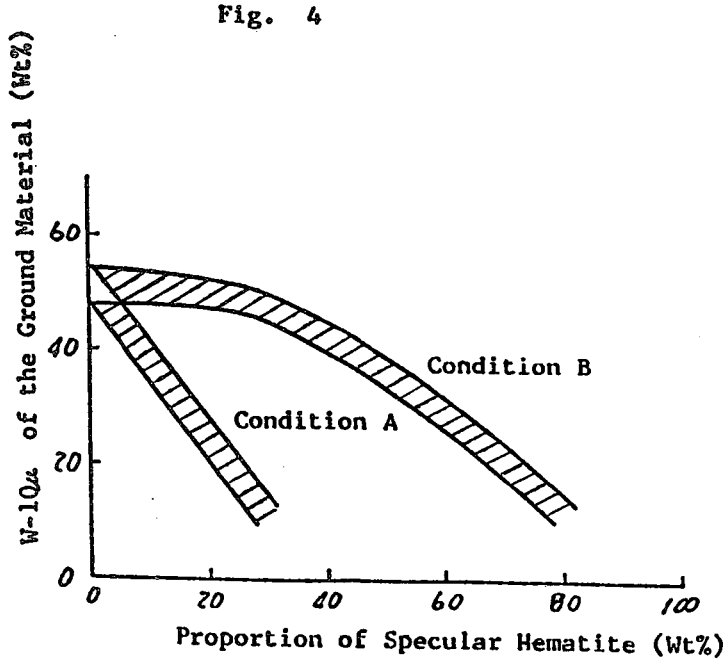
FIG. 4 shows the relation between the mixing proportion of specular hematite and the $W-10\mu$ of the ground material for comparison of the whole mixing and the partial mixing.

Based on the above results of the experiments, the present inventors tried to crush only ores having a W.I. value not more than 20, and to mix with the starting material to be crushed, ores having a W.I. value more than 20 directly or without finely dividing, but in the form of particles not larger than 0.5 mm in diameter also, it has been found that the classifying point can be set to the finer side due to the decreased supply of ores to the crushing step, and thereby it is possible to increase the W−10μ of the crushed product so that a higher W−10μ can be obtained as compared with the mixture crushing, as shown in FIG. 4.

When the results of the mixture crushing in which the specular hematite having a W.I. value of 24 is admixed to with the crushing material (Condition A in FIG. 4) are compared with the results when obtained by crushing only the ore having a W.I. value of 12 and admixing the non-crushed specular hematite powders with the crushed ore in a similar mixing proportion (Condition B), it is very clear that the W−10μ is maintained high even when the specular hematite is present in a high proportion of the mixture.

Thus, the lower limit 12% of the W−10μ as illustrated in FIG. 1 can be maintained when the specular hematite is present in amounts up to 80% under the condition B as illustrated in FIG. 4, and with this mixing proportion, green pellets having the same strength as expected by green pellets obtained by crushing easy-to-grind ores of 20% ore can be obtained, so that the crushing load can be markedly reduced as compared with the ordinary crushing step, in which the whole of the ore mixture is crushed.

An explanations will be made hereinunder concerning the mixing conditions.

Figure 5:
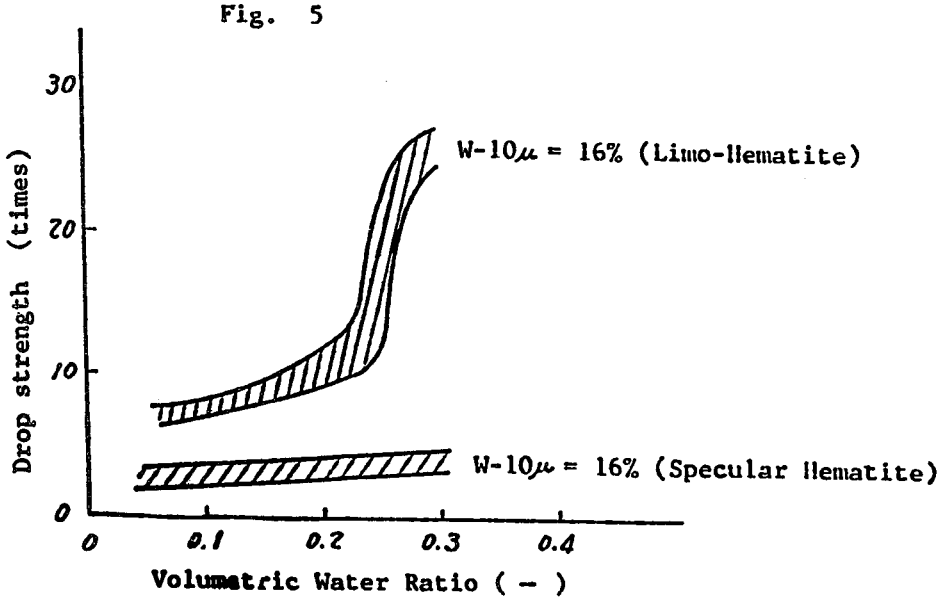
FIG. 5 shows the relation between the volumetric water ratio at the time of ore mixing and the drop strength.

The pelletizing experiments have been conducted by the present inventors using limo-hematite and specular hematite ores in the form of very fine powders of 10 μm or less in diameter. The results, formulated as the relation between the volumetric water ratio and the drop strength of the green pellets, are shown in FIG. 5 from which it is understood that when the volumetric water ratio is 0.25 or higher, the drop strength increases. Here also, the limo-hematite is preferable, and no substantial effect can be obtained when the specular hematite is ground. Further, when the volumetric water ratio is increased at the time of mixing the ores, it has been observed that the very fine particles of 10 μm or less in diameter adhere around the coarse particles, and this aherence of the very fine particles is considered to produce the improved pelletizability and the increased drop strength of the green pellets. Thus, it is very important to provide good mixing of ores in order to obtain success in pelletizing processes.

In order to obtain improved mixing of the ores, the nature of the liquid to be added to the ores may be modified by adding a certain agent, instead of increasing the amount of the liquid as mentioned just above.

The ore mixing for producing the pellets is usually done by treating the wetted ores in a ball mill, and up to now there is no better equipment to improve the mixing result considerably. Therefore, the present inventors have conducted pelletizing experiments using a wet-type ball mill for the ore mixing and a dish-type pelletizer, and it has been discovered through the experiments that the strength of resultant green pellets can be markedly increased when a liquid, such as ethylene glycol, which has a very small contact angle and a very small gas-liquid surface tension as compared with the ordinary water, is added to the ores to be mixed.

Thus, it is essential to provide adequate wettability in order to obtain a satisfactory ore mixing. The wetting may be considered in the following three aspects and can be expressed by the magnitude of the surface free energy.

Work of adhesion $W_{L/S}=\gamma_{G/L}(l+\cos\theta)$ (dyn/cm)

Work of spread $S_{L/S}=-\gamma_{G/L}(l-\cos\theta)$ (dyn/cm)

Work of immersion $A_{L/S}=\gamma_{G/L}\cos\theta$ (dyncm)

$\theta$=contact angle $\gamma_{G/L}$=gas-liquid surface tension (dyn/cm)

In order to increase the work of adhesion, the work of spread and the work of immersion, it is necessary to increase $W_{L/S}$, $S_{L/S}$ and $A_{L/S}$ respectively, and in order to have satisfactory mixing of the ores, it is important to increase all of $W_{L/S}$, $S_{L/S}$ and $A_{L/S}$ together. Regarding the contact angle $\theta$, it must be small for all types of the wettings. Meanwhile, the gas-liquid surface tension must be small for the expansion wetting, but must be large for the adhesion wetting and the immersion wetting. It is understood from these facts that the contact angle and the gas-liquid surface tension must be remarkably small as compared with that of ordinary water.

Figure 6:
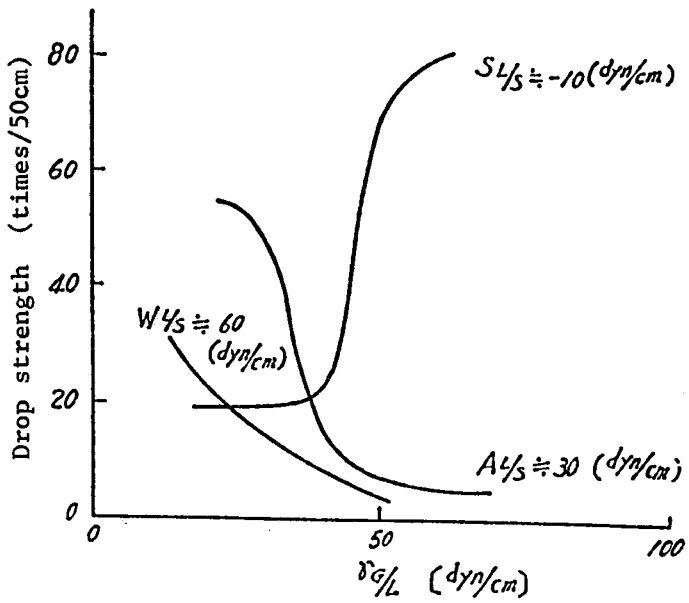
FIG. 6 shows the relation between the drop strength of green pellets and the gas-liquid surface tension of the aqueous solution added during the ore mixing.

On the basis of the above considerations, pelletizing experiments have been conducted using substances having different contact angles and gas-liquid surface tensions, with the expansion coefficient or the work of adhesion being kept constant. Specular hematite from South America and specular hematite from North America were mixed and admixed with 10 wt% cement clinker. Then an aqueous solution of the above substances was added to the mixture during the mixing in a ball mill and pellets were prepared on a dish-type pelletizer. The results are shown in FIG. 6.

Number of times that the pellet can be dropped from a 50 cm height onto times of natural dropping of the pellet from a 50 cm height onto a steel plate until it is broken or cracked.

Figure 7:
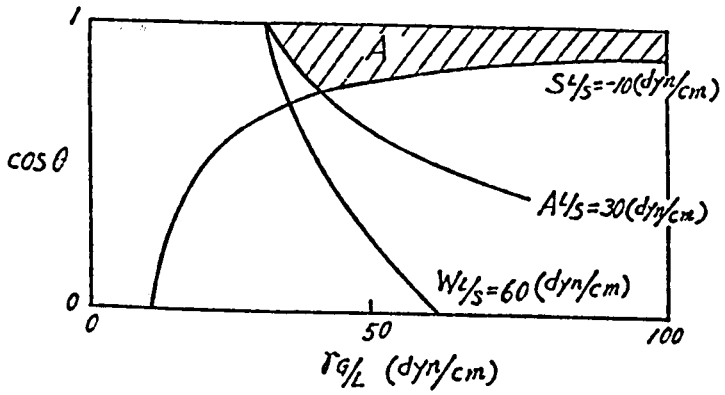
FIG. 7 shows the relation between the contact angle and gas-liquid surface tension in relation to the free energy of the wetting.

Also the relation between the contact angle and the gas-liquid surface tension is shown in connection with the free energy of wettings in FIG. 7 from which it is clearly understood that when $S_{L/S}$ is constant, a change of $\gamma_{G/L}$ means a change of $W_{L/S}$ and $A_{L/S}$, and when $A_{L/S}$ and $W_{L/S}$ are constant, a change of $\gamma_{G/L}$ means a change of $S_{L/S}$. From FIG. 6, when $S_{L/S} \div -10$ (dyn/cm), tangible effects are obtained if $\gamma_{G/L} \geqq 40$ (dyn/cm), and when $A_{L/S} \div 30$ (dyn/cm), tangible effects are obtained if $\gamma_{G/L} \leqq 40$.

However, when $W_{L/S} \div 60$ (dyn/cm), the effect is not apparent. From FIG. 7, it is understood that a remarkable effect is obtained in the zone A, and also it is understood that the effect is not clear when $W_{L/S} \div 60$ (dyn/cm). Thus, the zone A is considered to have $S_{L/S}$ more than two times higher than that of ordinary water an adhesion tension 0.6 or more times of that of ordinary water.

The contact angle is measured by the permeation rate using a glass tube of 0.7 cm diameter filled with glass particles of 120 μm diameter with about a 0.38 space ratio.

The concentration of the aqueous solution to be added at the time of the ore mixing depends on the types of ores and the ore particle size. However, less than 0.1 vol.% of the solution is not effective, while more than 5 vol.% of the solution causes blocking of the material and adhesion of the ore particles to each other. Therefore, it is necessary that the solution added to the ore mixture in an amount ranging from 0.1 vol.% to 5 vol.%.

Meanwhile, cement clinker was divided into powders of a Blain Index (JIS R5201) of 3000 $cm^2/g$ and admixed in an amount of 10 wt. % to the ore mixture. The ore mixing was done as above and pelletizing was performed in a dish-type pelletizer, and the resultant pellets were cured. The results revealed that similar strength as obtained by ore mixing with ordinary water alone and pelletizing can be obtained. In this way, the strength of green pellets can be increased without adverse effects on the development of the cured strength in the non-fired pellet process.

As understood from the above facts, in the present invention, it is still possible to pelletize the raw ores even when the proportion of coarse particles is considerably larger than that in a conventional raw ore mixture for pelletizing, and it is possible to maintain the required strength of green pellets. Further, according to the present invention, it is possible to pelletize the specular hematite which has been hard to pelletize by the conventional art and in this case also the required strength of green pellets can be maintained.

As described hereinabove, the ore mixing can be markedly improved in respect to both the amount and quality of the liquid by using an aqueous solution defined in the present invention in an amount equivalent to a volumetric water ratio of not less than 0.25, and the present invention is most advantageous in this point.

The present invention is advantageous for production non-fired pellets from powder iron ores. Thus, according to the present invention, the raw material for pelletizing may be prepared by mixing 20% or more of crushed limonite with 80% or less of non-crushed or roughly crushed specular hematite, preferably of a particle size of 0.5 mm max, and adding to the mixture a water-curing binder, such as portland cement, portland cement clinker. Further, according to the present invention, other types of iron ores are blended, or additives, such as silica stone, blast furnace slag, and dolomite are added so as to adjust the $CaO/SiO_2$ of the resultant mixture preferably in a range from 1.2 to 3.1, more preferably in a range so as to assure the ratio of the slag amount to the total raw material in a range from 13 to 35%.

Still further according to the present invention, water is added to the raw material in a volumetric water ratio of 0.25 or more during the mixing of the raw ores and/or an aqueous solution having a spreading coefficient to the raw material of two or more times larger than that of a pure water and having an adhesion tension at least 0.6 times larger than that of a pure water is added to the raw material during the mixing, then the raw material is pelletized into green pellets and the green pellets are cured without using fine ore for filling up; that is the pellets are piled and cured without movement (primary curing state). The pellets after the primary curing stage are crushed and piled again and cured so as to develop enough strength by means of, for example, a blast furnace (secondary curing stage). Or if necessary, inorganic substances are added to the green pellets, and then the pellets are rotated through a continuous rotating drum so as to form a solid thin layer of 0.5 mm or less of the inorganic substances on the surface of pellets, and these pellets, by themselves or with the green pellets, are subjected to the above curing stages. In this way, the non-fired pellets which show excellent crushing strength and excellent reduction ability in a blast furnace can be obtained.

The present invention will be more clearly understood from the following preferred embodiments.

DESCRIPTION OF THE PREFERRED EMBODIMENTS

EXAMPLE 1

Limonite from Australia as the ore of W.I. not larger than 20 KWH/T and specular hematite from South America as the ore of W.I. larger than 20 KWH/T were subjected to grinding tests and the results are shown in Table 3.

Table 3

| Raw Materials | A | B | C | D | E |
|---|---|---|---|---|---|
| Proportion of ore of W.I. not larger than 20 KWH/T (wt. %) | 100 | 85 | 85 | 60 | 30 |
| Proportion of ore of W.I. larger than 20 KWH/T (wt. %) | 0 | 15 | 15 | 40 | 70 |
| Average load of raw material W.I. (KWH/T) | 13.5 | 15.0 | 15.0 | 17.5 | 18.9 |
| Grinding conditions | Whole mixed and ground | Same as A | Only one of W.I. not larger than 20KWH/T was ground | Same as C | Same as C |
| W - 10μ (wt. %) of ground material | 51 | 23 | 42 | 26 | 15 |

In the table, A represents the standard, B represents the mixture with 15% specular hematite, and in C to E ores other than the specular hematite were ground and thus obtained ground ores were mixed with non-ground specular hematite.

According to the present invention, even with the addition of 40% specular hematite, the W−10μ is higher than that obtained by grinding the mixture with 15% specular hematite (B). Thus the advantage of the present invention is remarkable.

Further, 10% cement clinker was added to the raw material shown in Table 3 and the mixtures were mixed in a wet ball mill with the addition of water in a volumetric water ratio of 0.3, and pelletized in a disk pelletizer of 1.5 m in diameter. The results are shown in Table 4. The cement clinker used here had a particle size having a Blain Index. (hereinafter called Bi), of 3300 ($cm^2/g$) according to JIS R5201.

Table 4

| Raw materials | A | B | C | D | E |
|---|---|---|---|---|---|
| Drop strength (times) | 45.0 | 7.3 | 41.5 | 24.6 | 14.8 |
| Crushing strength (kg/p) | 3.8 | 2.3 | 3.3 | 4.0 | 4.2 |

As understood from the above results, when only the ores of W.I. not larger than 20 (C–E) were ground, specular hematite was added thereto, and the mixtures were pelletized into green pellets (C–E), the resultant properties were far better than those obtained by grinding the whole mixture material (B), and even as good as those of the standard (A).

EXAMPLE 2

Limonite from Australia as the ore of W.I. not larger than 20 KWH/T and specular hematite from South America as the ore of W.I. larger than 20 KWH/T were used to prepare the raw materials and pelletized. The results are shown in Table 5.

Table 5

| | |
|---|---|
| Material (A) | |
| Proportion of ore of W.I. not larger than 20 KWH/T | 30 wt. % |
| Proportion of ore of W.I. larger than 20 KWH/T | 70 wt. % |
| Grinding conditions | Only the ore of W.I. not larger than 20 KWH/T was ground |
| W - 10μ of ground material | 15 wt. % |
| Material (B) | |
| Proportion of ore of W.I larger than 20 KWH/T | 100 wt. % |
| Grinding conditions | Only 30% of the ore was crushed |
| W - 10μ of ground material | 15 wt. % |

In the material (A), the amount of fine particles of 10 μm or smaller was composed of an ore of W.I. not larger than 20 KWH/T, and in the material (B), the amount of the fine particles was composed of the ore of a W.I. larger than 20 KWH/T. To these materials, 10% of cement clinker (Bi=3500) was added, and the mixture was mixed in a wet-type ball mill. During the mixing, ethyleneglycol was added to the mixtures in different concentrations with different volumetric water ratios as shown in Table 6 and the thus prepared materials were pelletized in a disc pelletizer of 1.5 m in diameter. The results are shown in Table 6.

Table 6

| Ethylene-glycol (vol. %) \ Volumetric water ratio | 0.05 | 0.25 | 0.3 |
|---|---|---|---|
| 0 | 7.0 / 3.1 | 13.4 / 5.8 | 21.3 / 8.1 |
| 1 | | 21.1 / 7.9 | 38.2 / 13.0 |
| 3 | | 39.2 / 12.8 | 60.8 / 30.6 |

In the table, the upper figures represent the drop strength (times) of the material (A), and the lower figures represent that of the material (B). The ethyleneglycol used in this example had a spreading coefficient to the raw material at least two times higher than that of a pure water, and an adhesion tension at least 0.6 time more than that of a pure water. As shown in Table 6, when the material (A) is compared with the material (B), the effect of the volumetric water ratio is more remarkable in the material (A) than that in the material (B). Further, when ethyleneglycol is added, the strength is considerably increased also in the material (B), but the increase is more remarkable in the material (A).

As described above, the present invention has huge advantages because it makes possible to use iron ores of W.I. not smaller than 20 which are hard to grind in a large proportion and economically, and the present invention is applicable to production of oxidized pellets, reduced pellets as well as the non-fired pellets.

What is claimed is:

1. A method for producing high-strength pellets requiring less grinding cost, comprising:
   preferentially grinding into fine particles not larger than 10 μm, an easy-to-grind ore, which is effective as fine particles to enhance the strength of the resultant pellets and which has a Grinding Work Index (W.I.) of not higher than 20 KWH/ton;
   admixing 20% by weight or more of the fine particles thus-obtained with a hard-to-grind ore in the form of coarse particles not larger than 0.5 mm, said coarse particles having a Grinding Work Index of larger than 20 KWH/ton and which coarse particles by themselves are not effective to enhance the strength of the resulting pellets; and pelletizing the mixture of particles.

2. A method according to claim 1, in which water is added to the ore mixture in an amount to maintain a volumetric water ratio of 0.25 or higher prior to pelletizing.

3. A method according to claim 1, in which an aqueous solution having a spreading coefficient at least two times larger than that of pure water and having an adhesion tension at least 0.6 time larger than that of the pure water is added to the ores during the mixing.

4. A method according to claim 1, in which water is added to the ore mixing in an amount to maintain a volumetric water ratio of 0.25 or higher prior to pelletizing and an aqueous solution having a spreading coefficient at least two times larger than that of pure water and having an adhesion tension at least 0.6 time larger than that of the pure water is added to the ores during the mixing.

5. A method according to claim 1, in which the easy-to-grind ore is one selected from the group consisting of limo-hematite, limonite or magnetite and the hard-to-grind ore is specular hematite.

6. A method according to claim 1, in which the easy-to-grind ore has a Grinding Work Index of not larger than 10 KWH/ton.

7. A method according to claim 1, in which the fine and coarse particles are mixed in a wet ball mill and then pelletized in a disc pelletizer.

* * * * *